US010774525B2

(12) United States Patent
Harada et al.

(10) Patent No.: US 10,774,525 B2
(45) Date of Patent: Sep. 15, 2020

(54) SANDWICH PANEL

(71) Applicant: NIPPON STEEL & SUMIKIN COATED SHEET CORPORATION, Tokyo (JP)

(72) Inventors: Kiyokazu Harada, Hyogo (JP); Mitsuhiko Yazaki, Tokyo (JP); Yoshio Kayama, Tokyo (JP); Yoshinori Suenaga, Miyagi (JP)

(73) Assignee: NIPPON STEEL COATED SHEET CORPORATION, Tokyo (JP)

( * ) Notice: Subject to any disclaimer, the term of this patent is extended or adjusted under 35 U.S.C. 154(b) by 0 days.

(21) Appl. No.: 16/334,024

(22) PCT Filed: Aug. 22, 2017

(86) PCT No.: PCT/JP2017/029973

§ 371 (c)(1),
(2) Date: Mar. 18, 2019

(87) PCT Pub. No.: WO2018/055965

PCT Pub. Date: Mar. 29, 2018

(65) Prior Publication Data

US 2019/0271153 A1 Sep. 5, 2019

(30) Foreign Application Priority Data

Sep. 21, 2016 (JP) ..... 2016-184208

(51) Int. Cl.
*B32B 15/00* (2006.01)
*E04B 2/72* (2006.01)
(Continued)

(52) U.S. Cl.
CPC ..... *E04B 2/721* (2013.01); *E04B 2/56* (2013.01); *E04F 10/08* (2013.01)

(58) Field of Classification Search
CPC .... B32B 3/02; B32B 3/06; B32B 3/08; B32B 15/046; B32B 15/08; B32B 15/18;
(Continued)

(56) References Cited

U.S. PATENT DOCUMENTS 3,785,103 A * 1/1974 Turner ..... B32B 37/12 52/309.11
4,976,081 A 12/1990 Litzenberger
(Continued)

FOREIGN PATENT DOCUMENTS

CN 1033669 A 7/1989
CN 2129789 Y 4/1993
(Continued)

OTHER PUBLICATIONS

International Search Report in PCT/JP2017/029973, dated Oct. 10, 2017. 5pp.

*Primary Examiner* — Gisele D Ford
(74) *Attorney, Agent, or Firm* — Hauptman Ham, LLP

(57) ABSTRACT

A sandwich panel includes a first plate member and a second plate member, each of which is metallic, a spacer unit which is metallic and formed in the shape of a rectangular frame, and a core member. The core member is arranged in a region surrounded with the spacer unit between the first plate member and the second plate member. The spacer unit is made up of a plurality of spacers that are formed as separate members. The first plate member and the second plate member are bonded to the core member and each of the plurality of spacers.

4 Claims, 3 Drawing Sheets

(51) Int. Cl.
*E04F 10/08* (2006.01)
*E04B 2/56* (2006.01)

(58) Field of Classification Search
CPC . E04C 2/08; E04C 2/26; E04C 2/2885; E04C 2/292
See application file for complete search history.

(56) References Cited

U.S. PATENT DOCUMENTS 6,119,427 A * 9/2000 Wyman ..... E04B 1/12 52/127.11
6,676,234 B2 * 1/2004 Herbeck ..... E04C 2/292 312/236
8,689,511 B2 * 4/2014 Fleming, III ..... B32B 21/08 52/582.1
2008/0127594 A1 * 6/2008 Kennedy ..... B32B 3/08 52/630
2011/0173911 A1 * 7/2011 Propst ..... B32B 3/06 52/309.13
2019/0323235 A1 * 10/2019 Benson ..... E04C 2/044

FOREIGN PATENT DOCUMENTS

| | | | |
|---|---|---|---|
| CN | 2895844 | Y | 5/2007 |
| CN | 201079162 | Y | 7/2008 |
| CN | 201372540 | Y | 12/2009 |
| CN | 201507213 | U | 6/2010 |
| CN | 201894377 | U | 7/2011 |
| CN | 204804123 | U | 11/2015 |
| CN | 205224503 | U | 5/2016 |
| CN | 105714978 | A | 6/2016 |
| CN | 205577297 | U | 9/2016 |
| JP | S50-76623 | B | 7/1975 |
| JP | S52-33048 | Y | 7/1977 |
| JP | H7-42291 | A | 2/1995 |
| JP | H9-60141 | A | 3/1997 |
| JP | 2015-40432 | A | 3/2015 |
| JP | 2009-57794 | A | 3/2019 |

* cited by examiner

SANDWICH PANEL

RELATED APPLICATIONS

The present application is National Phase of International Application Number PCT/JP2017/029973, filed Aug. 22, 2017, and claims priority based on Japanese Patent Application No. 2016-184208, filed Sep. 21, 2016.

TECHNICAL FIELD

The present invention relates to a sandwich panel.

BACKGROUND ART

Patent Literature 1 discloses an exterior louver formed as a hollow extruded cement plate.

A panel formed as a hollow extruded cement plate, such as the exterior louver disclosed in Patent Literature 1, is too heavy to install easily. In addition, such a panel also requires curing. Thus, it takes a lot of time and trouble to manufacture such a panel.

Besides, the material itself of the hollow extruded cement plate tends to crack or peel easily. Therefore, part of an exterior louver formed as such a hollow extruded cement plate could drop off either during or after its installation.

CITATION LIST

Patent Literature

Patent Literature 1: JP 2009-57794 A

SUMMARY OF INVENTION

It is therefore an object of the present invention to provide a sandwich panel that may have a lighter weight and be manufactured by a simplified manufacturing process.

A sandwich panel according to an aspect of the present invention includes: a first plate member which is metallic; a second plate member which is arranged to face the first plate member and metallic; a spacer unit which is metallic and formed in a shape of a rectangular frame; and a core member.

The spacer unit is interposed between the first plate member and the second plate member. The core member is arranged in a region surrounded with the spacer unit between the first plate member and the second plate member. The spacer unit is made up of a plurality of spacers that are formed as separate members.

The first plate member is bonded to a surface, facing toward the first plate member, of the core member. The second plate member is bonded to another surface, facing toward the second plate member, of the core member.

The first plate member is bonded to a surface, facing toward the first plate member, of each of the plurality of the spacers. The second plate member is bonded to another surface, facing toward the second plate member, of each of the plurality of the spacers.

DESCRIPTION OF EMBODIMENTS

The embodiments to be described below generally relate to a sandwich panel, and more particularly relate to a sandwich panel in which a spacer unit in the shape of a rectangular frame and a core member are sandwiched between a pair of plate members.

First Embodiment

Figure 1:
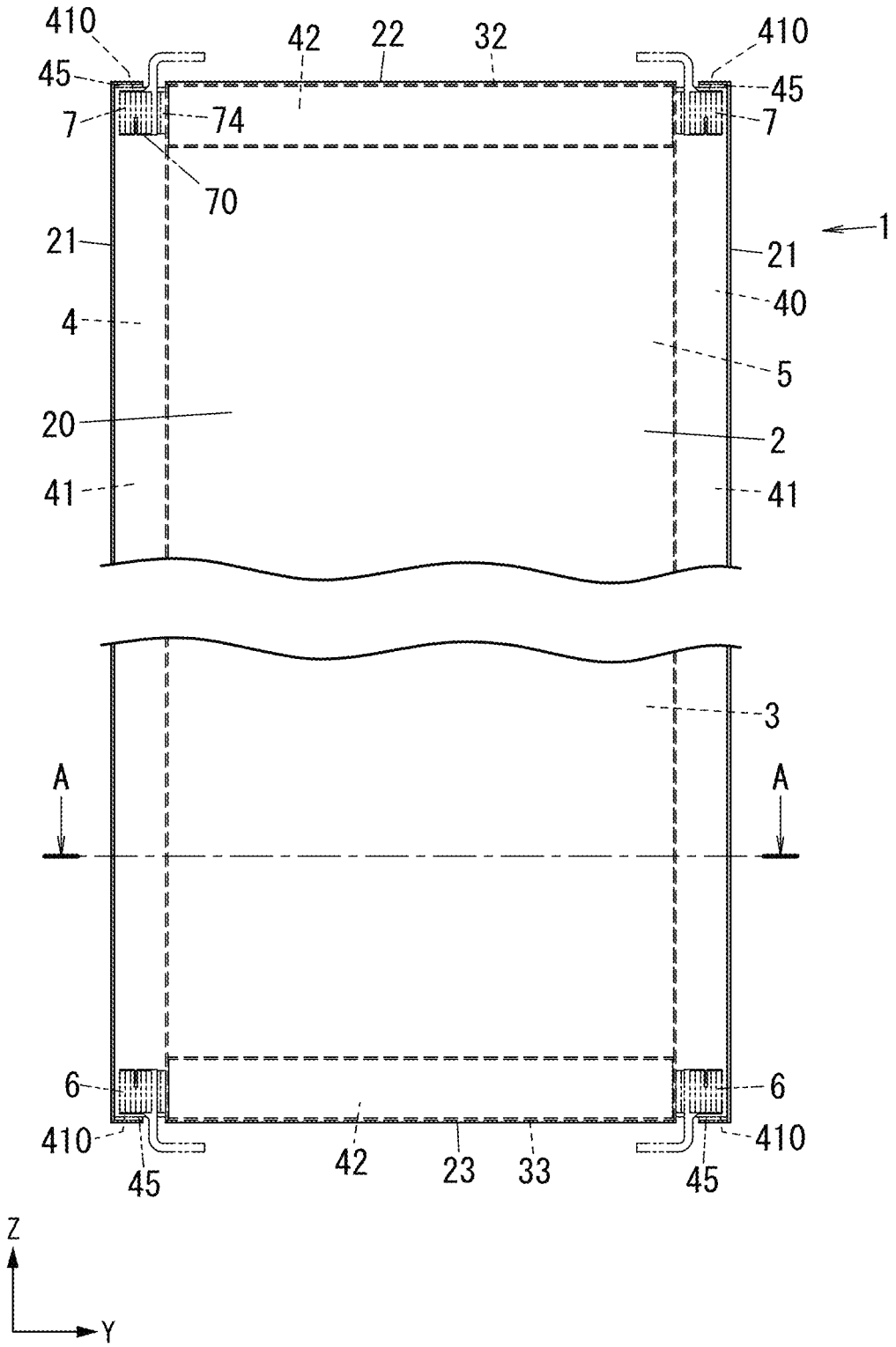
FIG. 1 is a front view illustrating a sandwich panel according to a first embodiment.
Figure 2A:
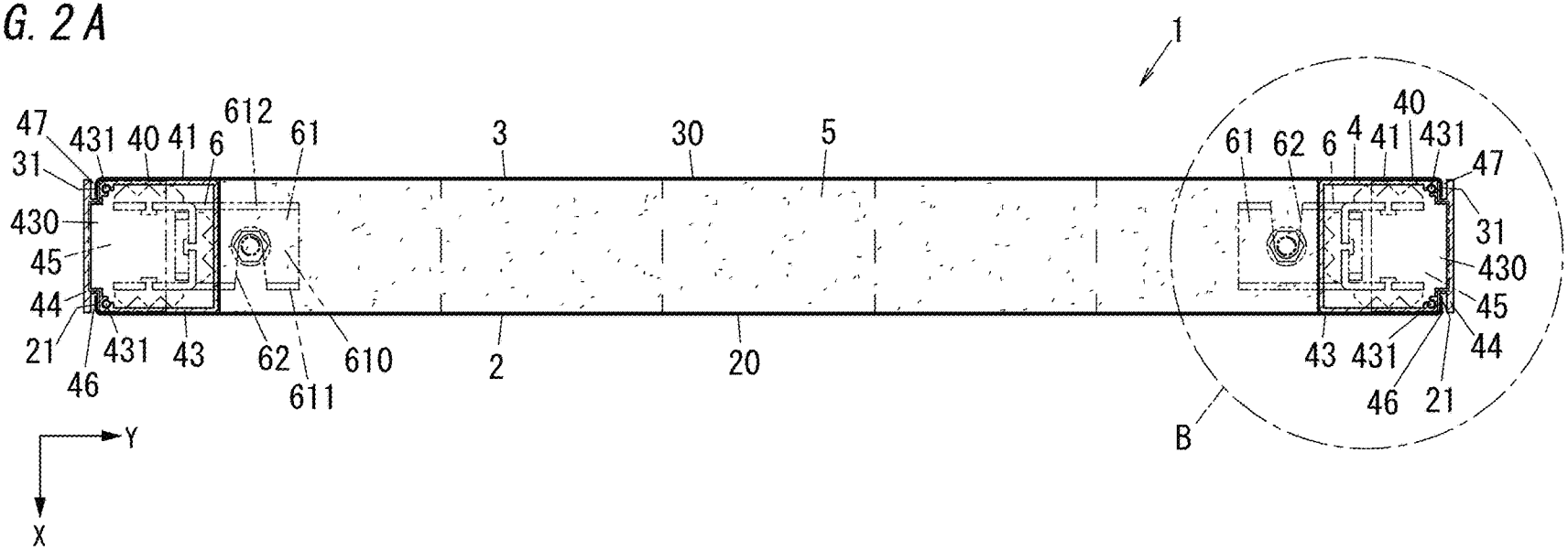
FIG. 2A is a cross-sectional view thereof taken along the plane A-A shown in FIG. 1.
Figure 2B:
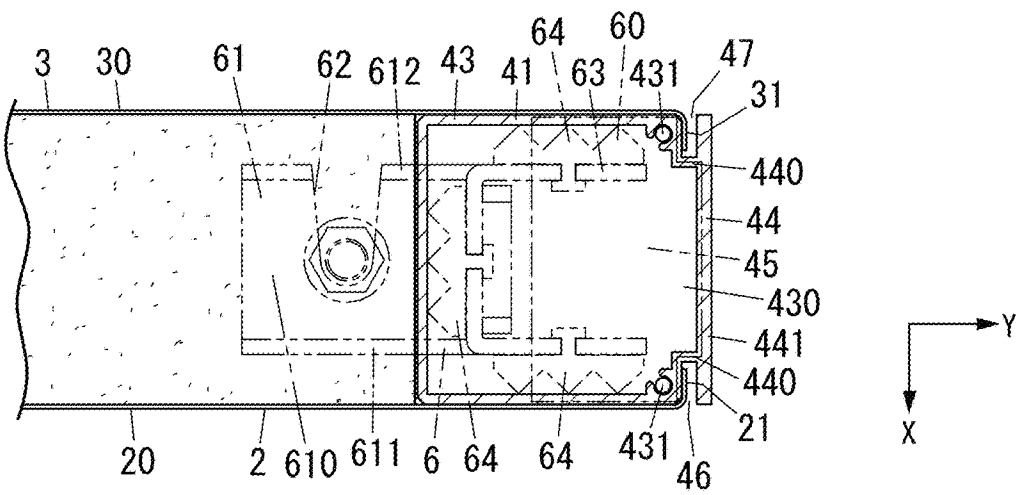
FIG. 2B is an enlarged cross-sectional view of the portion B shown in FIG. 2A.

FIG. 1 and FIGS. 2A and 2B illustrate a sandwich panel 1 according to a first embodiment. The sandwich panel 1 is suitably used as a non-bearing wall. Specifically, the sandwich panel 1 may be used as an exterior louver installed outside of a building, an interior louver installed inside of a building, or a partition wall, for example.

The sandwich panel 1 has the shape of a rectangular plate. The sandwich panel 1 may be provided for a building in a standing position such that its own length is parallel to the vertical direction. In the following description, respective constituent elements of the sandwich panel 1 will be described on the supposition that the thickness of the sandwich panel 1 defines the forward/backward direction, the length of the sandwich panel 1 defines the upward/downward direction, and the width of the sandwich panel 1 defines the rightward/leftward direction. In the drawings, the arrow X indicates the forward direction, the arrow Y indicates the rightward direction, and the arrow Z indicates the upward direction.

As shown in FIGS. 1 and 2A, the sandwich panel 1 includes a first plate member 2 which is metallic, a second plate member 3 which is also metallic, a spacer unit 4 which is metallic and formed in the shape of a rectangular frame, and a core member 5. A pair of first mounting members 6 and a pair of second mounting members 7 for use to mount the sandwich panel 1 onto a building are attachable to the spacer unit 4.

The spacer unit 4 in the shape of a rectangular frame is disposed over the entire outer periphery between the first plate member 2 and the second plate member 3. The core member 5 is disposed over the entire region surrounded with the spacer unit 4 between the first plate member 2 and the second plate member 3.

The spacer unit 4 is made up of a plurality of spacers 40 that are formed as separate members. The plurality of spacers 40 are arranged to form the rectangular frame.

The plurality of spacers 40 includes: a pair of straight tubular, longer-side spacers 41 forming a pair of longer sides of the spacer unit 4; and a pair of shorter-side spacers 42 forming a pair of shorter sides of the spacer unit 4.

The pair of longer-side spacers 41 each have the same longitudinal dimension (i.e., the length measured in the upward/downward direction). The pair of shorter-side spacers 42 each have the same longitudinal dimension (i.e., the length measured in the rightward/leftward direction). The pair of longer-side spacers 41 and the pair of shorter-side spacers 42 all have the same dimension measured in the forward/backward direction (i.e., the same thickness). The upper shorter-side spacer 42 is interposed between the respective upper ends of the pair of longer-side spacers 41, while the lower shorter-side spacer 42 is interposed between the respective lower ends of the pair of longer-side spacers 41.

The first plate member 2 constitutes the front surface of the sandwich panel 1. The first plate member 2 includes a front surface portion 20 formed in the shape of a rectangular plate and arranged in front of the spacer unit 4 and the core member 5, and a pair of side surface portions 21 arranged on the right and left of the spacer unit 4. The first plate member 2 further includes an upper surface portion 22 arranged over the spacer unit 4 and a lower surface portion 23 arranged under the spacer unit 4.

The pair of side surface portions 21 respectively protrude backward from the right and left edges of the front surface portion 20. The upper surface portion 22 protrudes backward from the top edge of the front surface portion 20. The lower surface portion 23 protrudes backward from the bottom edge of the front surface portion 20. The pair of side surface portions 21, the upper surface portion 22, and the lower surface portion 23 are all generally perpendicular to the front surface portion 20. The pair of side surface portions 21 are provided for the right and left edges of the front surface portion 20 over the entire length thereof in the upward/downward direction. In other words, the first plate member 2 includes, on at least one side edge thereof (on both side edges in this embodiment), a side surface portion 21 protruding toward the longer-side spacer 41 over the entire length thereof. The upper surface portion 22 is provided for a portion of the upper edge of the front surface portion 20. The portion faces, over the entire length thereof in the rightward/leftward direction, the upper shorter-side spacer 42. Likewise, the lower surface portion 23 is provided for a portion of the lower edge of the front surface portion 20. The portion faces, over the entire length thereof in the rightward/leftward direction, the lower shorter-side spacer 42.

The second plate member 3 constitutes the rear surface of the sandwich panel 1. The second plate member 3 includes a rear surface portion 30 formed in the shape of a rectangular plate and arranged behind the spacer unit 4 and the core member 5, and a pair of side surface portions 31 arranged on the right and left of the spacer unit 4. The second plate member 3 further includes an upper surface portion 32 arranged over the spacer unit 4 and a lower surface portion 33 arranged under the spacer unit 4.

The pair of side surface portions 31 respectively protrude forward from the right and left edges of the rear surface portion 30. The upper surface portion 32 protrudes forward from the top edge of the rear surface portion 30. The lower surface portion 33 protrudes forward from the bottom edge of the rear surface portion 30. The pair of side surface portions 31, the upper surface portion 32, and the lower surface portion 33 are all generally perpendicular to the rear surface portion 30. The pair of side surface portions 31 are provided for the right and left edges of the rear surface portion 30 over the entire length thereof in the upward/downward direction. In other words, the second plate member 3 includes, on at least one side edge thereof (on both side edges in this embodiment), a side surface portion 31 protruding toward the longer-side spacer 41 over the entire length thereof. The upper surface portion 32 is provided for a portion of the upper edge of the rear surface portion 30. The portion faces, over the entire length thereof in the rightward/leftward direction, the upper shorter-side spacer 42. Likewise, the lower surface portion 33 is provided for a portion of the lower edge of the rear surface portion 30. The portion faces, over the entire length thereof in the rightward/leftward direction, the lower shorter-side spacer 42.

The first plate member 2 and the second plate member 3 are each formed by folding a metal plate. Examples of the metal plates include a painted steel plate, a zinc plated steel plate, a Galvalume steel plate®, SGL® steel plate, a stainless steel plate, an aluminum steel plate, and a titanium steel plate. Note that these are only examples and should not be construed as limiting. The metal plate may have a thickness of 0.35 mm to 1.2 mm, for example.

As shown in FIG. 2A, the pair of longer-side spacers 41 each include a spacer body 43 arranged between the front surface portion 20 of the first plate member 2 and the rear surface portion 30 of the second plate member 3, and a decorative cover 44 arranged on the right or left outside of the spacer body 43. Specifically, in the longer-side spacer 41 on the right, the decorative cover 44 is arranged on the right of the spacer body 43. In the longer-side spacer 41 on the left, the decorative cover 44 is arranged on the left of the spacer body 43. Each of the pair of longer-side spacers 41 is an extruded product of aluminum including the spacer body 43 and the decorative cover 44, which are formed integrally with each other. Each of the pair of longer-side spacers 41 has a consistent cross-sectional shape over the entire length thereof.

The spacer body 43 has an opening at each of the two longitudinal ends thereof (i.e., at each of the upper and lower ends thereof). The spacer body 43 is formed in the shape of a rectangular frame, of which a plane cross section has an opening 430 cut through a portion thereof. The opening 430 is cut through an outer frame portion, located on the right or left end, of the spacer body 43 so as to be located in the middle thereof in the forward/backward direction. Specifically, in the longer-side spacer 41 on the right, the opening 430 is cut through the right frame portion of the spacer body 43. In the longer-side spacer 41 on the left, the opening 430 is cut through the left frame portion of the spacer body 43.

The spacer body 43 has two insertion holes 431, which are located at two outer corners (adjacent to the decorative cover 44) on the right or left end, out of the four corners thereof, and which run in the upward/downward direction. A fixture such as a screw may be inserted into, and fixed into, each of these insertion holes 431.

As shown in FIG. 2B, the decorative cover 44 includes a pair of protruding pieces 440 protruding outward to the right or to the left from the front and rear edges of the opening 430 of the spacer body 43 and a cover body 441 formed in the shape of a rectangular plate integrally with the respective tips of the pair of protruding pieces 440. The dimension measured in the forward/backward direction of the cover body 441 is approximately equal to the dimension measured in the forward/backward direction of the spacer body 43. The cover body 441 is arranged with a gap left with respect to the spacer body 43.

The decorative cover 44 has an opening at each of the two longitudinal ends (at each of the upper and lower ends) thereof. The region inside of the decorative cover 44 (i.e., the region surrounded with the cover body 441 and the pair of protruding pieces 440) communicates, through the opening 430, with the region inside of the spacer body 43. Thus, at each of the two longitudinal ends of each of the longer-side spacers 41, there is an opening 410 formed by the region inside of the spacer body 43 and the region inside of the decorative cover 44. The opening 410 is provided to receive either the first mounting member 6 or the second mounting member 7 inserted.

The sandwich panel 1 further includes cover members 45 attached to both longitudinal ends of the pair of longer-side spacers 41. That is to say, the sandwich panel 1 includes four cover members 45. All of these four cover members 5 have the same dimensions and the same shape. Each of the cover members 45 is a plate member, of which the shape corresponds to that of the openings at the longitudinal ends of the longer-side spacers 41. More specifically, each of the cover members 45 is formed in such a shape that closes an outer half (i.e., either a right half or a left half) (the outer half located adjacent to the decorative cover 44) of the opening at an associated longitudinal end of the spacer body 43 and also entirely closes the opening at an associated longitudinal end of its associated decorative cover 44. As shown in FIG. 1, each of the cover members 45 closes the opening at an associated longitudinal end of its associated longer-side spacer 41 entirely but a portion to which either the first mounting member 6 or the second mounting member 7 is inserted. Each cover member 45 is secured with a fixture such as a screw onto the associated longitudinal end of the associated longer-side spacer 41. At this time, each fixture such as a screw is inserted into, and fixed onto, an associated insertion hole 431 of the spacer body 43.

As shown in FIGS. 2A and 2B, each of the pair of longer-side spacers 41 has a front groove portion 46 and a rear groove portion 47. The front groove portion 46 is formed so as to be surrounded with an outer part at the right or left end (i.e., located adjacent to the decorative cover 44) of the frame portion of the spacer body 43, the front protruding portion 440, and the cover body 441. The rear groove portion 47 is formed so as to be surrounded with an outer part at the right or left end (i.e., located adjacent to the decorative cover 44) of the frame portion of the spacer body 43, the rear protruding portion 440, and the cover body 441.

As shown in FIG. 1, each of the pair of shorter-side spacers 42 is straight tubular and has an opening at each of the two longitudinal ends thereof. Each of the pair of shorter-side spacers 42 has a rectangular frame cross section taken along a plane perpendicular to its length. Each of the pair of shorter-side spacers 42 may be implemented as a square steel pipe, for example. Alternatively, each of the shorter-side spacers 42 may also be made of aluminum.

The upper shorter-side spacer 42 has right and left ends thereof abutted on the upper ends of the pair of longer-side spacers 41 to have its openings at the right and left ends closed. Likewise, the lower shorter-side spacer 42 has right and left ends thereof abutted on the lower ends of the pair of longer-side spacers 41 to have its openings at the right and left ends closed. In this embodiment, the upper shorter-side spacer 42 is arranged such that the upper surface thereof is flush with the upper surface of the cover members 45 attached to the respective upper ends of the pair of longer-side spacers 41. The lower shorter-side spacer 42 is arranged such that the lower surface thereof is flush with the lower surface of the cover members 45 attached to the respective lower ends of the pair of longer-side spacers 41.

As shown in FIG. 2A, the core member 5 is made up of a plurality of block members, which are arranged side by side in the rightward/leftward direction such that those block members form a single plate as a whole. Each of these block members may be formed by binding, with a binder, some fibrous inorganic material such as rock wool or glass wool. The core member 5 is arranged in the entire region surrounded with the spacer unit 4. The core member 5 is as thick as the spacer unit 4. Alternatively, the core member 5 may also be configured as some resin foam (such as urethane foam, phenol foam, or styrene foam) filling the entire region surrounded with the spacer unit 4.

The entire front surface (i.e., the surface facing the first plate member 2) of the core member 5 is bonded to the entire front surface portion 20 of the first plate member 2 but an outer peripheral portion thereof. The entire rear surface (i.e., the surface facing the second plate member 3) of the core member 5 is bonded to the entire rear surface portion 30 of the second plate member 3 but an outer peripheral portion thereof.

The entire front surface (i.e., the surface facing the first plate member 2) of each of the plurality of spacers 40 is bonded to the outer peripheral portion of the front surface portion 20 of the first plate member 2. The entire rear surface (i.e., the surface facing the second plate member 3) of each of the plurality of spacers 40 is bonded to the outer peripheral portion of the rear surface portion 30 of the second plate member 3.

Specifically, the respective entire front surfaces (i.e., the surfaces facing the first plate member 2) of the respective spacer bodies 43 of the pair of longer-side spacers 41 are bonded to the right and left end portions of the front surface portion 20 of the first plate member 2. The respective entire rear surfaces (i.e., the surfaces facing the second plate member 3) of the respective spacer bodies 43 of the pair of longer-side spacers 41 are bonded to the right and left end portions of the rear surface portion 30 of the second plate member 3.

In addition, the respective entire front surfaces (i.e., the surfaces facing the first plate member 2) of the pair of shorter-side spacers 42 are bonded to the upper and lower end portions of the front surface portion 20 of the first plate member 2. The respective entire rear surfaces (i.e., the surfaces facing the second plate member 3) of the pair of shorter-side spacers 42 are bonded to the upper and lower end portions of the rear surface portion 30 of the second plate member 3.

This allows the spacer unit 4 and the core member 5 to be bonded to, and fixed onto, the entire front surface portion 20 of the first plate member 2 and the entire rear surface portion 30 of the second plate member 3. The right and left side surface portions 21 of the first plate member 2 are accommodated in the respective front groove portions 46 of the pair of longer-side spacers 41. The right and left side surface portions 31 of the second plate member 3 are accommodated in the respective rear groove portions 47 of the pair of longer-side spacers 41.

The upper surface portion 22 of the first plate member 2 covers a front half of the upper surface of the upper shorter-side spacer 42. The lower surface portion 23 of the first plate member 2 covers a front half of the lower surface of the lower shorter-side spacer 42. The upper surface portion 32 of the second plate member 3 covers a rear half of the upper surface of the upper shorter-side spacer 42. The lower surface portion 33 of the second plate member 3 covers a rear half of the lower surface of the lower shorter-side spacer 42.

In this embodiment, the upper surface portion 22 of the first plate member 2 further has portions to cover respective front halves of the upper surfaces of the cover members 45 attached to the respective upper ends of the pair of longer-side spacers 41. The lower surface portion 23 of the first plate member 2 further has portions to cover respective front halves of the lower surfaces of the cover members 45 attached to the respective lower ends of the pair of longer-side spacers 41. The upper surface portion 32 of the second plate member 3 further has portions to cover respective rear halves of the upper surfaces of the cover members 45 attached to the respective upper ends of the pair of longer-side spacers 41. The lower surface portion 33 of the second plate member 3 further has portions to cover respective rear halves of the lower surfaces of the cover members 45 attached to the respective lower ends of the pair of longer-side spacers 41.

The first plate member 2, the spacer unit 4, and the core member 5 are bonded together with the first mounting members 6 and the second mounting members 7 inserted into the respective openings 410 at the upper and lower ends of the pair of longer-side spacers 41 and with the cover members 45 attached. The second plate member 3, the spacer unit 4, and the core member 5 are also bonded together in the same manner.

In the sandwich panel 1 according to the embodiment described above, the metallic spacer unit 4 and the core member 5 are sandwiched between the first plate member 2 and second plate member 3 that are also metallic, and the spacer unit 4 and the core member 5 are bonded to, and integrated with, the first plate member 2 and the second plate member 3.

Therefore, the sandwich panel 1 according to this embodiment requires no curing process that would be needed when a panel is configured as an extruded cement plate, thus shortening, and thereby simplifying, the manufacturing process.

In addition, the sandwich panel 1 according to this embodiment allows the spacer unit 4, which is metallic and formed in the shape of a rectangular frame that forms an outer peripheral portion between the first plate member 2 and the second plate member 3, to take charge of the majority of the strength of the panel. In addition, in the sandwich panel 1 according to this embodiment, the core member 5, arranged in the region surrounded with the spacer unit 4 between the first plate member 2 and the second plate member 3 and bonded to the front surface portion 20 of the first plate member 2 and the rear surface portion 30 of the second plate member 3, not only further increases the strength of the panel but also reduces waving to be caused by thermal expansion of the front surface portion 20 of the first plate member 2 and the rear surface portion 30 of the second plate member 3. Furthermore, in the sandwich panel 1 according to this embodiment, the core member 5 is configured as a plate member including, for example, rock wool as a main component, and occupies the majority of the region between the first plate member 2 and the second plate member 3, thus reducing the overall weight of the panel while maintaining sufficient strength for the panel, compared to when the entire panel is configured as an extruded cement plate.

Figure 3A:
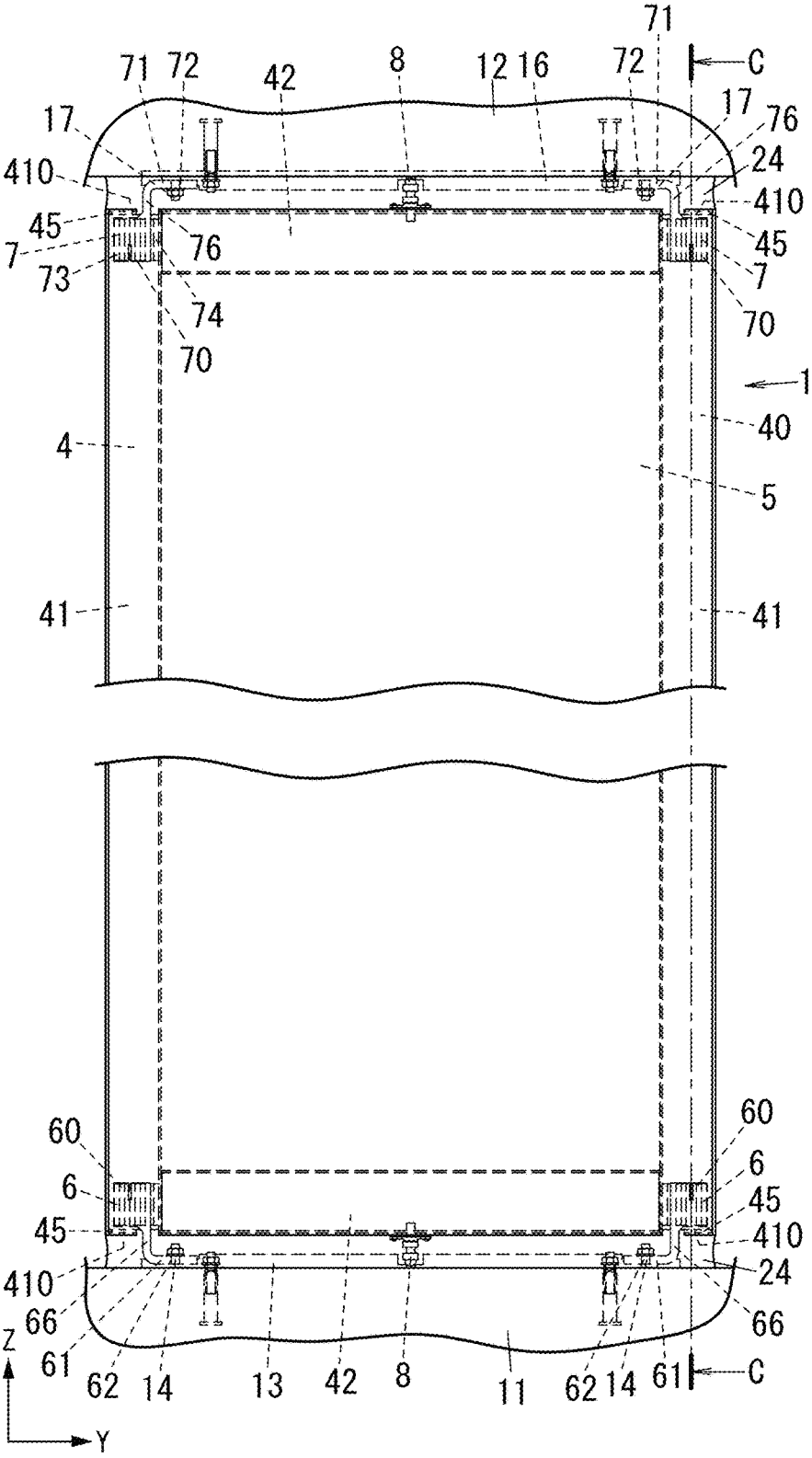
FIG. 3A is a front view illustrating an exemplary structure to which the sandwich panel is mounted.
Figure 3B:
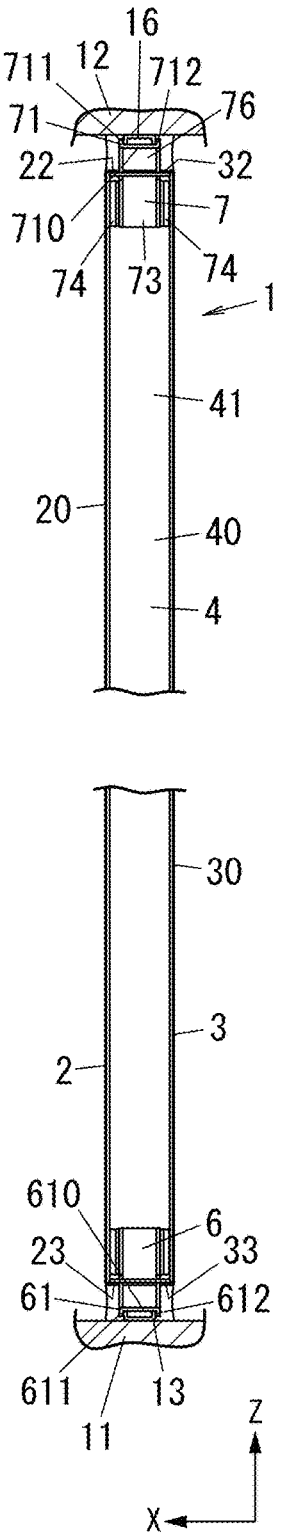
FIG. 3B is a cross-sectional view thereof taken along the plane C-C shown in FIG. 3A.

The sandwich panel 1 according to this embodiment is installed between a building's lower supporting member 11 and upper supporting member 12 via the pair of first mounting members 6 and the pair of second mounting members 7 as in an exemplary mounting structure shown in FIGS. 3A and 3B, for example.

In this mounting structure, the sandwich panel 1 is mounted onto each of these supporting members 11 and 12 so as to be able to swing, when story displacement arises between these supporting members 11 and 12 at the time of an earthquake, for example, in such a manner as to follow the displacement.

Specifically, each of the pair of first mounting members 6 includes a fitting portion 60 to be fitted elastically into the opening 410 at the lower end of an associated longer-side spacer 41 and an fixing portion 61 located outside (i.e., under) the longer-side spacer 41 and used to anchor the longer-side spacer 41 onto the building (i.e., the lower supporting member 11). Each fixing portion 61 has a cutout portion 62 that has been cut out (either forward or backward) along the thickness of the spacer unit 4. Each of the pair of first mounting members 6 further includes an intermediate portion 66 located between the fitting portion 60 and the fixing portion 61.

Likewise, each of the pair of second mounting members 7 includes a fitting portion 70 to be fitted elastically into the opening 410 at the upper end of an associated longer-side spacer 41 and an fixing portion 71 located outside (i.e., over) the longer-side spacer 41 and used to anchor the longer-side spacer 41 onto the building (i.e., the upper supporting member 12). Each fixing portion 71 has a cutout portion 72 that has been cut out (either forward or backward) along the thickness of the spacer unit 4. Each of the pair of second mounting members 7 further includes an intermediate portion 76 located between the fitting portion 70 and the fixing portion 71.

As shown in FIG. 2B, the fitting portion 60 includes an insertion portion 63 with a generally U-plane cross section and a plurality of (e.g., three in this embodiment) elastic members 64 attached to the insertion portion 63. The insertion portion 63, the intermediate portion 66, and the fixing portion 61 are integrated together and continuous with each other.

As shown in FIGS. 2B and 3B, the fixing portion 61 includes a body 610 in the shape of a rectangular plate, a first fixing piece 611 extending downward from a front end of the body 610, and a second fixing piece 612 extending downward from a rear end of the body 610. The first fixing piece 611 and the second fixing piece 612 are parallel to each other and generally perpendicular to the body 610.

In the first mounting member 6 arranged on the right, the cutout portion 62 has been cut out forward to cover a range from a middle in the rightward/leftward direction of the second fixing piece 612 through a middle in the rightward/leftward direction of the body 610. The width of the cutout portion 62 increases toward its opening (i.e., backward). The cutout portion 62 covers a range from the rear edge of the body 610 through a middle thereof in the forward/backward direction. The cutout portion 62 runs through the second fixing piece 612 over the entire length thereof in the upward/downward direction.

As shown in FIG. 2A, in the first mounting member 6 arranged on the left, the cutout portion 62 has been cut out backward to cover a range from a middle in the rightward/leftward direction of the first fixing piece 611 on the front through a middle in the rightward/leftward direction of the body 610. The width of the cutout portion 62 increases toward its opening (i.e., forward). The cutout portion 62 covers a range from the front edge of the body 610 through a middle thereof in the forward/backward direction. The cutout portion 62 runs through the first fixing piece 611 over the entire length thereof in the upward/downward direction.

In each of the pair of first mounting members 6, the insertion portion 63, intermediate portion 66, and fixing portion 61 thereof may be made of a metallic material, and the elastic members 64 may be made of rubber such as ethylene propylene diene rubber. However, this is only an example and should not be construed as limiting. Alternatively, the elastic members 64 may also be made of any other material with elasticity, instead of rubber.

Each of the pair of second mounting members 7 has substantially the same structure as an associated one of the first mounting members 6 rotated 180 degrees on a vertical plane.

In the following description, any constituent member of the second mounting members 7 having the same function as a counterpart of the first mounting members 6 described above will be referred to by the same name as that counterpart's, and a detailed description thereof will be omitted herein.

As shown in FIGS. 3A and 3B, each of the pair of second mounting members 7 includes a fitting portion 70, an fixing portion 70, and an intermediate portion 76. The fitting portion 70 includes an insertion portion 73 and a plurality of elastic members 74. The fixing portion 71 includes a cutout portion 72. The fixing portion 71 further includes a body 710, a first fixing piece 711, and a second fixing piece 712.

In the second mounting member 7 arranged on the left, the cutout portion 72 has been cut out backward to cover a range from a middle in the rightward/leftward direction of the first fixing piece 711 as the front piece of the fixing portion 71 through a middle in the rightward/leftward direction of the body 710. In the second mounting member 7 arranged on the right, the cutout portion 72 has been cut out forward to cover a range from a middle in the rightward/leftward direction of the second fixing piece 712 as the rear piece of the fixing portion 71 through a middle in the rightward/leftward direction of the body 710.

Each of the pair of first mounting members 6 is fitted into its associated longer-side spacer 41 by bringing, by press fitting, the three elastic members 64 into contact with the inner surfaces at the lower end of the longer-side spacer 41. Each of the pair of first mounting members 6 is slidable in the upward/downward direction along the associated longer-side spacer 41, thus making the position of the fixing portion 61 adjustable in the upward/downward direction. In this embodiment, partially closing the opening at the lower end of each longer-side spacer 41 with the cover member 45, the lower surface portion 23 of the first plate member 2, and the lower surface portion 33 of the second plate member 3 reduces the chances of the fitting portion 60 coming out of the longer-side spacer 41.

Likewise, each of the pair of second mounting members 7 is fitted into its associated longer-side spacer 41 by bringing, by press fitting, the three elastic members 74 into contact with the inner surfaces at the upper end of the longer-side spacer 41. Each of the pair of second mounting members 7 is slidable in the upward/downward direction along the associated longer-side spacer 41, thus making the position of the fixing portion 71 adjustable in the upward/downward direction. In this embodiment, partially closing the opening at the upper end of each longer-side spacer 41 with the cover member 45, the upper surface portion 22 of the first plate member 2, and the upper surface portion 32 of the second plate member 3 reduces the chances of the fitting portion 70 coming out of the longer-side spacer 41.

The mounting structure according to this embodiment further includes a pair of rotational supporting members 8 for supporting the sandwich panel 1 rotatably. One of the pair of rotational supporting members 8 is located between the upper supporting member 11 and the sandwich panel 1. The other of the pair of rotational supporting members 8 is located between the lower supporting member 12 and the sandwich panel 1.

In this embodiment, the lower rotational supporting member 8 is provided to protrude downward from the lower surface of the lower shorter-side spacer 42, and the upper rotational supporting member 8 is provided to protrude upward from the upper surface of the upper shorter-side spacer 42. The lower rotational supporting member 8 is provided in the middle in the rightward/leftward direction and forward/backward direction of the lower surface of the lower shorter-side spacer 42 so as to be aligned with the center of mass of the sandwich panel 1 in the upward/downward direction. The upper rotational supporting member 8 is provided in the middle in the rightward/leftward direction and the forward/backward direction of the upper surface of the upper shorter-side spacer 42 so as to be aligned with the center of mass of the sandwich panel 1 in the upward/downward direction. Each of the pair of rotational supporting members 8 has an adjustable length in the upward/downward direction.

The mounting structure according to this embodiment further includes an fixing plate 13 to be secured with screws onto the lower supporting member 11 and a pair of fixtures 14 provided for the fixing plate 13. The mounting structure according to this embodiment further includes another fixing plate 16 to be secured with screws onto the upper supporting member 12 and a pair of fixtures 17 provided for the fixing plate 16. The pair of fixing plates 13 and 16 each have a U-side cross section (see FIG. 3B). Each of the pair of fixtures 14 includes a bolt secured to the fixing plate 13 and a nut attached to the bolt. Likewise, each of the pair of fixtures 17 also includes a bolt secured to the fixing plate 16 and a nut attached to the bolt.

Next, an exemplary method for installing the mounting structure for the sandwich panel 1 will be described.

In the sandwich panel 1 for use in this example, the spacer unit 4 and the core member 5 have already been fixed between the first plate member 2 and the second plate member 3 and the pair of first mounting members 6, the pair of second mounting members 7, the plurality of cover members 45, and the pair of rotational supporting members 8 have already been attached to the spacer unit 4. Each of the pair of first mounting members 6 and pair of second mounting members 7 has already been inserted deeper into its associated longer-side spacer 41.

First of all, the fixing plate 13 is secured with screws onto the lower supporting member 11, and the fixing plate 16 is secured with screws onto the upper supporting member 12. At this time, these fixing plates 13 and 16 are secured with screws so as to face each other in the upward/downward direction.

Next, the sandwich panel 1 is arranged between the upper fixing plate 13 and the lower fixing plate 16, and at least one of the upper and lower rotational supporting members 8 has its length increased to support the sandwich panel 1 rotatably between these fixing plates 13 and 16.

Subsequently, the sandwich panel 1 is rotated around the pair of rotational supporting members 8 to insert the respective bolts of the pair of fixtures 14, provided for the fixing plate 13, one to one into the respective cutout portions 62 of the pair of first mounting members 6 and also insert the respective bolts of the pair of fixtures 17, provided for the fixing plate 16, one to one into the respective cutout portions 72 of the pair of second mounting members 7.

Thereafter, the respective fixing portions 61 of the pair of first mounting members 6 are pulled out of the longer-side spacers 41 and brought into contact with the fixing plate 13, and the respective fixing portions 71 of the pair of second mounting members 7 are pulled out of the longer-side spacers 41 and brought into contact with the fixing plate 16. At this time, the fixing plate 13 is positioned between the first fixing piece 611 and the second fixing piece 612 of the fixing portion 61 of each of the pair of first mounting members 6, and the fixing plate 16 is positioned between the first fixing piece 711 and the second fixing piece 712 of the fixing portion 71 of each of the pair of second mounting members 7, thus regulating the rotation of the sandwich panel 1.

Next, the respective nuts of the pair of fixtures 14 are fastened to secure the respective fixing portions 61 of the pair of first mounting members 6 onto the fixing plate 13, and the respective nuts of the pair of fixtures 17 are fastened to secure the respective fixing portions 71 of the pair of second mounting members 7 onto the fixing plate 16.

Subsequently, the gap between the lower supporting member 11 and the sandwich panel 1 and the gap between the upper supporting member 12 and the sandwich panel 1 are each filled and closed with an elastically deformable sealant 24. This allows the pair of first mounting members 6, the pair of second mounting members 7, the pair of rotational supporting members 8, the fixing plates 13 and 16, and the two pairs of fixtures 14 and 17 to be covered with the sealant 24.

In the mounting structure thus installed for the sandwich panel 1 according to this embodiment, the sandwich panel 1 is mounted to be swingable with respect to the lower supporting member 11 and the upper supporting member 12. Thus, the mounting structure for the sandwich panel 1 according to this embodiment allows the sandwich panel 1 to swing, when an earthquake happens, for example, in such a manner as to follow the story displacement caused by the earthquake. This reduces the chances of the sandwich panel 1 dropping off or being broken down even in such a situation.

Specifically, in the mounting structure for the sandwich panel 1 according to this embodiment, the first mounting member 6 and the second mounting member 7, each of which is mostly metallic, are inserted into the longer-side spacers 41 that is also metallic, thus making the longer-side spacers 41 breakable much less easily even upon the application of devastating force at the time of earthquake, for example, and thereby reducing the chances of the sandwich panel 1 being broken down.

Furthermore, when the mounting structure for the sandwich panel 1 according to this embodiment is installed outdoors, filling, with the core member 5, the region surrounded with the spacer unit 4 between the first plate member 2 and the second plate member 3 muffles the reverberating sound of rain falling down on the first plate member 2 or the second plate member 3, thus reducing the chances of causing a so-called "drum phenomenon (resonance transmission phenomenon)."

(Variations)

Next, variations of the sandwich panel 1 according to this embodiment and its mounting structure will be described.

The spacer unit 4 may be made up of a plurality of spacers 40 that are formed as separate members. That is to say, the spacer unit 4 does not have to be made up of the pair of longer-side spacers 41 and the pair of shorter-side spacers 42 but may include any other combination of spacers. For example, the spacer unit 4 may be made up of two L-shaped spacers 40. Also, the spacer unit 4 may have no openings 410 to which the first mounting members 6 or the second mounting members 7 are inserted.

The cover body 441 of the decorative cover 44 does not have to have a rectangular plate shape. Alternatively, the cover body 441 may also be formed such that the outer surface in the rightward/leftward direction (i.e., a surface facing away from the spacer body 43) is a curved surface with a convex arced plane cross section. That reduces the chances of the cover body 441 emitting a wind noise when the sandwich panel 1 is used as an exterior louver. Still alternatively, the cover body 441 may also have any other appropriate shape, instead of the rectangular plate shape or the curved surface shape.

Each of the pair of longer-side spacers 41 may consist of the spacer body 43 only with no decorative covers 44. In that case, each longer-side spacer 41 has a rectangular frame cross-sectional shape with no openings 430 when taken along a plane perpendicular to the longitudinal direction. Also, in that case, the first plate member 2 may have no pairs of side surface portions 21 and the second plate member 3 may have no pairs of side surface portions 31.

Furthermore, no matter whether the decorative covers 44 are provided or not, the first plate member 2 may include only one, or even neither, of the pair of side surface portions 21. Likewise, no matter whether the decorative covers 44 are provided or not, the second plate member 3 may include only one, or even neither, of the pair of side surface portions 31.

Furthermore, the mounting structure for the sandwich panel 1 does not have to be the structure described above as long as the structure allows the sandwich panel 1 to be mounted onto the supporting members 11 and 12 such that when story displacement arises between the supporting members 11 and 12 at the time of an earthquake, for example, the sandwich panel 1 swings so as to follow the displacement. That is to say, the first mounting members 6 and the second mounting members 7 do not have to have the structure described above but may be fixed non-slidably to the sandwich panel 1. In that case, the fixing plates 13 and 16 and the fixtures 14 and 17 may have the capability of making the sandwich panel 1 swingable.

The first plate member 2 may have not only the front surface portion 20 thereof bonded to the spacer unit 4 but also the upper surface portion 22 thereof secured with screws onto the upper shorter-side spacer 42. The second plate member 3 may have not only the rear surface portion 30 thereof bonded to the spacer unit 4 but also the upper surface portion 32 thereof secured with screws onto the upper shorter-side spacer 42. This allows these members to be fixed even more securely, compared to a situation where the first plate member 2, the second plate member 3, and the spacer unit 4 are integrated together only by bonding.

Optionally, the sandwich panel 1 may be installed in a facedown position onto a building such that its own length is parallel to the horizontal direction and that its own thickness is generally parallel to the vertical direction. Furthermore, the sandwich panel 1 does not always have to be installed in the upright position or in the facedown position but may also be installed in a tilted position onto a building such that its own length is tilted with respect to the vertical direction.

(Advantages)

A sandwich panel (1) according to a first aspect of the present invention, exemplified by the sandwich panel 1 of the first embodiment described above, is characterized by having the following first configuration:

Specifically, a sandwich panel (1) according to a first aspect includes: a first plate member (2) which is metallic; a second plate member (3) which is arranged to face the first plate member (2) and metallic; a spacer unit (4) which is metallic and formed in a shape of a rectangular frame; and a core member (5). The spacer unit (4) is interposed between the first plate member (2) and the second plate member (3). The core member (5) is arranged in a region surrounded with the spacer unit (4) between the first plate member (2) and the second plate member (3).

The spacer unit (4) is made up of a plurality of spacers (40) that are formed as separate members.

The first plate member (2) is bonded to a surface, facing toward the first plate member (2), of the core member (5).

The second plate member (3) is bonded to another surface, facing toward the second plate member (3), of the core member (5).

The first plate member (2) is bonded to a surface, facing toward the first plate member (2), of each of the plurality of the spacers (40). The second plate member (3) is bonded to another surface, facing toward the second plate member (3), of each of the plurality of the spacers (40).

The sandwich panel (1) according to the first aspect, having this first configuration, allows the spacer unit (4), which is metallic and formed in the shape of a rectangular frame that forms an outer peripheral portion between the first plate member (2) and the second plate member (3), to take charge of the majority of the strength of the panel. In addition, in the sandwich panel (1) according to the first aspect, the core member (5) arranged in a region inside the spacer unit (4) not only further increases the strength of the panel but also reduces waving to be caused by thermal expansion of the first plate member (2) and second plate member (3), both of which are metallic. Furthermore, the sandwich panel (1) according to the first aspect is allowed to use, as the core member (5), a lightweight member (such as a plate member including rock wool as a main component), thus reducing the overall weight of the panel while ensuring sufficient strength for the panel.

Besides, the sandwich panel (1) according to the first aspect may be formed simply by bonding both of the first plate member (2) and the second plate member (3) to each of the plurality of spacers (40) and the core member (5). That is to say, the sandwich panel (1) according to the first aspect requires no curing process that would be needed when the panel is formed out of an extruded cement plate, thus shortening, and thereby simplifying, the manufacturing process as well.

A sandwich panel (1) according to a second aspect, exemplified by the sandwich panel 1 of the first embodiment, may have the following second configuration in combination with the first configuration described above.

Specifically, in the sandwich panel (1) according to the second aspect, the plurality of the spacers (40) include a pair of straight tubular, longer-side spacers (41) forming a pair of longer sides of the spacer unit (4) in the shape of the rectangular frame. Each of the pair of the longer-side spacers (41) has an opening (410) at each longitudinal end thereof. The opening (410) is configured to receive a mounting member (which may be a first mounting member (6) or a second mounting member (7)) inserted. The mounting member is used to mount the sandwich panel (1) onto a building.

The sandwich panel (1) according to the second aspect, having this second configuration, may be mounted onto a building via the mounting member inserted into the opening provided at each longitudinal end of each of the pair of longer-side spacers (41). In such an embodiment, in the sandwich panel (1) according to the second aspect, inserting the mounting members into the metallic longer-side spacers (41) makes the longer-side spacers (41) breakable much less easily even upon the application of devastating force at the time of earthquake, for example, thus reducing the chances of the sandwich panel (1) being broken down.

A sandwich panel (1) according to a third aspect, exemplified by the sandwich panel 1 of the first embodiment, may have the following third configuration in combination with the first and second configurations described above.

Specifically, in the sandwich panel (1) according to the third aspect, the first plate member (2) includes a side surface portion (21) protruding from a side edge of the first plate member (2) toward the second plate member (3) over an entire length of the first plate member (2) (see FIG. 2B). The second plate member (3) includes a side surface portion (31) protruding from a side edge of the second plate member (3) toward the first plate member (2) over an entire length of the second plate member (3). The pair of the longer-side spacers (41) includes a groove portion (front groove portion (46)) to accommodate the side surface portion (21) of the first plate member (2) and another groove portion (rear groove portion (47)) to accommodate the side surface portion (31) of the second plate member (3).

In the sandwich panel (1) according to the third aspect, having this third configuration, the first plate member (2) and the second plate member (3) each have a shape with a folded side edge, thus increasing the strength so much as to reduce the chances of producing wrinkles on the surface (front surface portion (20)) of the first plate member (2) and on the surface (rear surface portion (30)) of the second plate member (3). In addition, in the sandwich panel (1) according to the third aspect, the side surface portion (21) of the first plate member (2) and the side surface portion (31) of the second plate member (3) are accommodated in the respective groove portions (the front groove portion (46) and rear groove portion (47)) of the pair of longer-side spacers (41). Thus, the sandwich panel (1) according to the third aspect curbs the decline in appearance caused by providing the side surface portions (21, 31) for the first plate member (2) and the second plate member (3), respectively.

Although the present invention has been described by way of exemplary embodiments illustrated on the drawings, those embodiments are only examples of the present invention. Rather, any of those embodiments may be readily modified, depending on a design choice or any other factor, without departing from a true spirit and scope of the present invention.

REFERENCE SIGNS LIST

1 Sandwich Panel
2 First Plate Member
21 Side Surface portion
3 Second Plate Member
31 Side Surface portion
4 Spacer Unit
40 Spacer
41 Longer-Side Spacer
46 Groove Portion (Front Groove Portion)
47 Groove Portion (Rear Groove Portion)
5 Core Member
6 Mounting Member (First Mounting Member)
7 Mounting Member (Second Mounting Member)

The invention claimed is:

1. A sandwich panel comprising:

a first plate member which is metallic;

a second plate member which is arranged to face the first plate member and metallic;

a spacer unit which is metallic and formed in a shape of a rectangular frame and interposed between the first plate member and the second plate member;

a core member arranged in a region surrounded with the spacer unit between the first plate member and the second plate member; and mounting members configured to mount the sandwich panel onto a building, the spacer unit being made up of a plurality of spacers that are formed as separate members, the first plate member being bonded to a surface, facing toward the first plate member, of the core member, the second plate member being bonded to another surface, facing toward the second plate member, of the core member, the first plate member being bonded to a surface, facing toward the first plate member, of each of the plurality of the spacers, the second plate member being bonded to another surface, facing toward the second plate member, of each of the plurality of the spacers, the plurality of the spacers including a pair of straight tubular, longer-side spacers forming a pair of longer sides of the spacer unit in the shape of the rectangular frame, and the mounting members being in an opening that each of the longer-side spacers has at each longitudinal end thereof.

2. The sandwich panel of claim 1, wherein the first plate member includes a side surface portion protruding from a side edge of the first plate member toward the second plate member over an entire length of the first plate member, the second plate member includes a side surface portion protruding from a side edge of the second plate member toward the first plate member over an entire length of the second plate member, and the pair of the longer-side spacers includes a groove portion to accommodate the side surface portion of the first plate member and another groove portion to accommodate the side surface portion of the second plate member.

3. The sandwich panel of claim 1, wherein each of the mounting members includes a fitting portion to be fitted elastically into the opening of the longer-side spacers and a fixing portion located outside the longer-side spacers and used to anchor the longer-side spacers onto the building, and each of the mounting members is slidable along the longer-side spacers in the longitudinal direction thereof.

4. The sandwich panel of claim 1, wherein the first plate member and the second plate member are bonded to the core member by an adhesive.

* * * * *